United States Patent [19]

Sandell

[11] 4,380,482

[45] Apr. 19, 1983

[54] STABILIZATION OF WATER-BEARING EXPLOSIVES HAVING A THICKENED CONTINUOUS AQUEOUS PHASE

[75] Inventor: Lionel S. Sandell, Hagerstown, Md.

[73] Assignee: E. I. Du Pont de Nemours and Company, Wilmington, Del.

[21] Appl. No.: 225,725

[22] Filed: Jan. 16, 1981

[51] Int. Cl.[3] ..... C06B 45/02

[52] U.S. Cl. ..... 149/21; 149/2; 149/36; 149/38; 149/41; 149/44; 149/47; 149/92

[58] Field of Search ..... 149/2, 21, 36, 38, 41, 149/44, 47, 92

[56] References Cited

U.S. PATENT DOCUMENTS

| | | | |
|---|---|---|---|
| 3,113,059 | 12/1963 | Ursenbach et al. | 149/41 |
| 3,297,502 | 1/1967 | Chrisp | 149/6 |
| 3,367,805 | 2/1968 | Clay et al. | 149/6 |
| 3,445,305 | 5/1969 | Lyerly | 149/39 |
| 3,453,158 | 7/1969 | Clay | 149/41 |
| 3,713,918 | 1/1973 | Forshey | 149/21 |
| 3,919,015 | 11/1975 | Bolza | 149/44 |
| 4,198,253 | 4/1980 | Kirchnerova | 149/44 |
| 4,207,125 | 6/1980 | Grant | 149/109.4 |

*Primary Examiner*—Stephen J. Lechert, Jr.
*Attorney, Agent, or Firm*—Diamond C. Ascani

[57] ABSTRACT

Water-bearing explosives comprising oxidizer, fuel, and sensitizer components in a thickened or gelled continuous aqueous phase are stabilized against the degradation of their thickened or gelled structure by the incorporation therein of iodide and/or iodate ions. Preferably, iodide ion is introduced by dissolving ammonium iodide or an alkali metal iodide in an aqueous liquor or sol containing the oxidizer component. The stabilization method is particularly useful in explosives containing a guar gum thickener and flake aluminum in the sensitizer component.

26 Claims, No Drawings

STABILIZATION OF WATER-BEARING EXPLOSIVES HAVING A THICKENED CONTINUOUS AQUEOUS PHASE

BACKGROUND OF THE INVENTION

1. Field of the Invention

The present invention relates to water-bearing explosives of the aqueous slurry type comprising a thickened or gelled continuous aqueous phase which contains inorganic oxidizing salt, fuel, and sensitizer components.

2. Description of the Prior Art

Gel- or slurry-type blasting agents and explosives comprise inorganic oxidizing salts, fuels, and sensitizers (one or more of each of these) dissolved or dispersed in a continuous liquid, usually aqueous, phase. The entire system is thickened and made water-resistant by the addition of thickeners or gellants such as galactomannans, which swell in water or other aqueous media to form viscous colloidal solutions or dispersions commonly referred to as "sols". Crosslinking of the galactomannan with an agent such as borax, potassium dichromate, or an antimony or bismuth compound converts the sol to a firmer gel form throughout which the other phases are dispersed.

Water-bearing explosives of the type described above, when stored for extended periods, especially with exposure to elevated temperatures, are susceptible to deterioration or degradation of varying degree, as evidenced by a reduction in the viscosity of sols and a softening or reduction in the firmness of gels, or, in extreme cases, by a virtual disappearance of the sol or gel structure with a resultant separation of solid and liquid phases. The utility of a given product at any given time will depend on the extent of the degradation which it has undergone. The inhibition of noticeable deterioration over extended periods is highly desirable because a composition which tends to thin out or soften during storage, while still of possible use in the thinned or softened state as a blasting agent or explosive, is of questionable value owing to the fact that such a condition may foreshadow a more catastrophic degradation, such as liquid separation, which can occur at any time. The complete disappearance of the sol or gel structure results in a product in which the other phases are no longer uniformly dispersed and for which resistance to dilution by water in the borehole has been lost. The resulting product can be difficult and sloppy to use, and no longer reliable in performance. Limp plastic film cartridges are difficult to load into boreholes, and are prone to becoming hung up or jammed in the hole. Also it may not be possible to position a blasting cap in cartridges which have become runny or soupy, and the explosive may well be lost to the surrounding formation when the cartridges are slit open.

The stability of a slurry-type explosive under a given set of time-temperature conditions depends on many factors including the type and amount of thickener therein, the salt/water ratio, the nature of the fuel(s) and sensitizer(s) present, and whether or not the thickener is crosslinked. Greater stability is generally shown, for example, by compositions having a thickener which is present in larger amounts and/or in crosslinked form. In some cases it may be possible to improve the storage stability or shelf life of a given product, e.g., by changing the nature of the materials therein or by increasing the amount of thickener, but it may not always be feasible to make such changes from a performance and/or economic standpoint.

Instability in slurry-type blasting agents heretofore often has been attributed to the presence of particulate aluminum which may be used as a fuel and/or a sensitizer. For example, U.S. Pat. No. 3,113,059 reports that aluminum reacts exothermically with the water in the blasting agent to form hydrogen, which constitutes an explosion hazard in the oxidizing environment and, in any event, degrades the product owing to the evaporation of water therefrom. The addition of an alkali metal or ammonium phosphate, preferably diammonium hydrogen phosphate, is said to inhibit the gassing resulting from the aluminum-water reaction. U.S. Pat. No. 3,367,805 states that inhibitors such as those disclosed and claimed in U.S. Pat. No. 3,113,059 may prevent, or assist in preventing, syneresis and hence stabilize the aluminum-containing composition physically. A phosphate-type stabilizer also is used in the aluminum-containing slurries of U.S. Pat. No. 3,453,158.

Mannitol and ammonium and alkali metal phosphates are described in U.S. Pat. No. 4,207,125 as corrosion inhibitors which may be incorporated into a thickened liquid pre-mix for a slurry explosive which is to contain particulate metal.

U.S. Pat. No. 3,297,502, which discloses that the desired consistency and stability in thickened aqueous explosives often are not achieved in the presence of reactive metals, teaches the protection of metallic fuel particles with a continuous, preformed coating of an oil and an aliphatic monocarboxylic acid.

In U.S. Pat. No. 3,445,305 the aqueous solution of inorganic oxidizing salt is reported as desirably retaining an alkalinity so as to preclude corrosion of equipment and prevent the contamination of blasting agent, particularly with regard to ions such as those of iron, copper, zinc, and aluminum, which, it is stated, would inhibit or destroy a gelling system.

Urea is taught in U.S. Pat. No. 3,713,918 as retarding gas evolution from metal-sensitized, cross-linked gelled slurry explosives, and a phosphate buffer is said to be important to avoid nullification of the long-term stabilizing effect of the urea.

It is disclosed in U.S. Pat. No. 4,198,253 that guar-thickened explosive slurries containing calcium nitrate, which are said to tend to degrade more quickly at elevated temperatures than do those devoid of this salt, can be made more stable by the use of a sulfonated guar gum derivative as the thickener.

SUMMARY OF THE INVENTION

This invention provides a method of stabilizing the thickened or gelled structure of a water-bearing explosive comprising oxidizer, fuel, and sensitizer components in a thickened or gelled continuous aqueous phase, said method comprising incorporating in the explosive a stabilizing amount of iodide ion, iodate ion, or a combination of iodide and iodate ions. Iodide ion is preferred. According to the present method, the stabilizer iodide and/or iodate ions are incorporated in the explosive by dissolving an iodide salt, an iodate salt, hydriodic acid, or iodic acid, or any combination of said salts and acids, in the explosive's aqueous phase, either by adding the salt or acid, or its aqueous solution, to an aqueous liquor containing the oxidizer component, or to a sol which contains the thickened aqueous liquor.

The invention also provides an improved water-bearing explosive produced by the method of this invention, which explosive comprises (1) oxidizer, (2) fuel, and (3) sensitizer components in a continuous aqueous phase having a thickened or gelled structure, and (4) iodide ion, iodate ion, or a combination of iodide and iodate ions as a stabilizer of the thickened or gelled structure, the sensitizer component being devoid of sensitizing gas bubbles formed (a) by the decomposition of hydrogen peroxide, when the stabilizer contains iodide ion and (b) by the decomposition of hydrazine, when the stabilizer contains iodate ion.

The oxidizer component consists essentially of one or more "inorganic oxidizing salts", which term, as used herein to define the oxidizer component, denotes salts of inorganic oxidizing acids exclusive of iodic acid. Thus, any iodate present in the explosive is present only in the small amount required to stabilize the thickened or gelled structure, as will be explained hereinafter, and forms no part of the inorganic oxidizing salt(s) used in larger amount in the oxidizer component.

DETAILED DESCRIPTION

The present invention is based on the discovery that small amounts of iodide or iodate ion inhibit the degradation of thickened or gelled water-bearing explosives, i.e., those referred to as "sols" (viscous colloidal solutions, as in uncrosslinked systems) as well as those referred to as "gels" (crosslinked systems). The thickened structure of aqueous sol explosives and the gelled structure of aqueous gel explosives have improved stability or shelf life (in terms of the length of time at a given temperature before the structure gives evidence of deterioration) when the explosive contains a small amount of iodide and/or iodate ion. This improved stability is exhibited in sols and gels of varying composition, and is of particular importance in compositions which are especially susceptible to degradation, e.g., those in which a polysaccharide thickener such as a galactomannan gum is present together with finely divided aluminum, especially pigment-grade aluminum, or compositions containing multivalent metal ion impurities.

The iodide and/or iodate ions are incorporated in the explosive by the addition of an iodide salt, an iodate salt, hydriodic acid, iodic acid, or any combination of these salts and acids, which is dissolved in the explosive's aqueous phase. These compounds, or an aqueous solution thereof, can be added to the aqueous liquor formed by dissolving the oxidizer component in water; or to the sol which forms when the aqueous liquor is thickened. Preferably, they are added before gelling has occurred.

The particular source of iodide or iodate ion added is not critical, provided that (a) it is sufficiently soluble in the explosive's aqueous phase to provide the desired concentration of iodide or iodate ion, and (b) it does not introduce cations in high enough concentration that would promote degradation of the sol or gel, or interfere with the functioning of the various components of the explosive. Alkali metal and alkaline-earth metal iodides and iodates, as well as ammonium and alkyl-substituted ammonium iodide and iodate can be added, and, of these, the alkali metal salts, especially the sodium and potassium salts, are preferred for economic reasons.

According to U.S. Pat. No. 3,919,015, cerous compounds, including iodide, are crosslinking agents for galactomannan gums. Inasmuch as control of the function of a given stabilizing compound may be more easily accomplished if it is kept independent of the control of other functions such as crosslinking, the present method and product will employ iodate ion as the stabilizer, and iodide ion will be absent, when the cerous ion is present. In most instances, moreover, iodides and iodates of the lanthanide series of rare earth elements, of which cerium is a member, will offer only academic interest for use in the present method and product because of their relative inaccessibility.

As is shown in Example 5 which follows, iodide ion has a stabilizing effect on the thickened structure of water-bearing explosives when present in concentrations as low as 4 parts per million, based on the weight of the explosive. However, the stabilizing effect is greater with higher iodide concentrations, and for this reason preferably at least about 30, and most preferably at least about 60, parts per million of iodide ion will be employed. Iodide concentrations of about 2% or higher can be used, although there appears to be no advantage in exceeding about 1%. Therefore, on the basis of economic considerations as well as degree of stabilization effected, an iodide ion concentration in the range of about from 0.006 to 1%, based on the weight of the explosive, is preferred.

Iodate ion has a stabilizing effect in concentrations as low as about 100 parts per million (as is shown in Example 4 which follows), although at least about 200 parts per million preferably will be employed to achieve greater stability. Although iodate concentrations as high as about 0.6% can be used (Example 6), there is evidence that at higher concentrations more severe time-temperature conditions (longer time and/or higher temperature) may cause the iodate to become reduced to iodine, and the sol or gel structure to become weakened. To provide stability under the more severe conditions, the iodate concentration preferably does not exceed about 0.3%, based on total explosive weight.

If the thickened or gelled structure is stabilized by a combination of iodide and iodate ions, the total concentration thereof may be as high as 2% or more, as was specified above for the iodide concentration, but the iodate concentration should not exceed about 0.6%, and preferably does not exceed 0.3%, as was specified above for the iodate concentration. The total iodide/iodate concentration preferably is no greater than about 1%.

It is understood that, within the above-defined stabilizer concentration ranges, different concentrations may be required with different slurry-type explosives to achieve a given stability level. The reason for this is that the stability of the uninhibited thickened or gelled structure varies depending on the composition. For example, the less thickener or more finely divided aluminum that a composition contains, the more stabilizer it may require to achieve a selected stability level. Also, the presence of multivalent metal ions such as the aluminum ion, or precipitated aluminum compounds, in the composition may make higher stabilizer concentrations advisable.

This invention applies to any water-bearing explosive comprising oxidizer, fuel, and sensitizer components in a thickened or gelled continuous aqueous phase. The oxidizer component, which usually constitutes at least about 20% of the weight of the explosive, consists of one or more of the inorganic oxidizing salts commonly employed in such explosives, e.g., ammonium, alkali metal, and alkaline-earth metal nitrates and perchlorates. Specific examples of such salts are ammonium nitrate, ammonium perchlorate, sodium nitrate, sodium perchlorate, potassium nitrate, potassium perchlorate, magnesium nitrate, magnesium perchlorate, and calcium nitrate. A preferred oxidizer component consists of ammonium nitrate, most preferably in combination with up to about 50 percent sodium nitrate (based on the total weight of inorganic oxidizing salts), which affords a more concentrated aqueous liquor. Preferably, the concentration of the oxidizing salt(s) in the aqueous liquor is as high as possible, e.g., about from 40 to 70 percent by weight at room temperature. In addition, some of the oxidizer component may be present as a dispersed solid, i.e., that which has been added to the liquor and/or that which has precipitated from a supersaturated liquor.

Fuel components for water-bearing explosives containing an inorganic oxidizing salt component are well-known in the art, and any of these may be present in the explosive of this invention. Non-explosive fuels include sulfur and carbonaceous fuels such as finely divided coal, gilsonite, and other forms of finely divided carbon; solid carbonaceous vegetable products such as cornstarch, wood pulp, sugar, ivory nut meal, and bagasse; and hydrocarbons such as fuel oil, paraffin wax, and rubber. In general, carbonaceous fuels may constitute up to about 25, and preferably about from 1 to 20, percent of the weight of the explosive.

Metallic fuels which may be present include finely divided aluminum, iron, and alloys of such metals, e.g., aluminum-magnesium alloys, ferrosilicon, and ferrophosphorus, as well as mixtures of such metals and alloys. The quantity of metallic fuels varies markedly with the particular fuel employed and can constitute up to about 50 percent of the total weight of the explosive. With finely divided aluminum, for example, about from 1 to 20 percent by weight usually is used; although up to about 40% may be used in special cases. With heavier metallic fuels such as ferrophosphorus and ferrosilicon, about from 10 to 30 percent usually is employed.

Water-insoluble self-explosive particles such as trinitrotoluene, pentaerythritol tetranitrate, cyclotrimethylenetrinitramine, and mixtures thereof can be used as fuels, while acting as sensitizers as well. However, it is preferred that the fuel and/or sensitizer components of the explosive of this invention contain, instead of water-insoluble explosives, water-soluble explosives and preferably nitric or perchloric acid salts derived from amines, including the nitrates and perchlorates of aliphatic amines, most preferably lower-alkyl, i.e., 1-3 carbon, amines such as methylamine, ethylamine, and ethylenediamine; alkanolamines such as ethanolamine and propanolamine; aromatic amines such as aniline; and heterocyclic amines such as hexamethylenetetramine. On the basis of availability and cost, nitric acid salts of lower-alkyl amines and alkanolamines are most preferred.

Flake, or pigment-grade, aluminum also may be present in the sensitizer component.

Preferably, the amount of fuel component is adjusted so that the total explosive composition has an oxygen balance of about from $-25$ to $+10\%$ and, except for those compositions containing the heavier metallic fuels such as ferrophosphorus and ferrosilicon, preferably the oxygen balance is between about $-10$ and $+10\%$. In special cases, the oxygen balance may be as low as $-40\%$.

In addition to the above-mentioned fuels which in some cases function as sensitizers, the explosive may contain dispersed gas bubbles or voids, which are part of the sensitizer component, e.g., in the amount of at least about 5 percent of the volume of the water-bearing explosive. Gas bubbles can be incorporated in the product by dispersing gas therein by direct injection, such as by air or nitrogen injection, or the gas can be incorporated by mechanical agitation and the beating of air therein. A preferred method of incorporating gas in the product is by the addition of particulate material such as air-carrying solid material, for example, phenol-formaldehyde microballoons, glass microballoons, perlite, or fly ash. Evacuated closed shells also can be employed. While the gas or void volume to be used in any given product depends on the amount and nature of the other sensitizer materials present, and the degree of sensitivity required in the product, preferred gas or void volumes generally are in the range of about from 3 to 35 percent. More than about 50 percent by volume of gas bubbles or voids usually is undesirable for the usual applications where a brisant explosion is desired. The gas bubbles or voids preferably are no larger than about 300 microns.

The gas bubbles also can be incorporated in the explosive by the in situ generation of gas in the thickened aqueous phase by the decomposition of a chemical compound therein. However, the use of chemical foaming by means of hydrogen peroxide and a catalyst for the decomposition thereof, or by means of hydrogen peroxide or other oxidizing agent in combination with hydrazine can reduce the effectiveness of commonly used thickeners or gellants and should be avoided. For example, U.S. Pat. No. 3,617,401 discloses the use of hydrogen peroxide and a potassium iodide catalyst to produce gas in a slurry explosive in deep boreholes. And U.S. Pat. No. 3,706,607 discloses the use of hydrazine and an oxidizing agent such as hydrogen peroxide that aids in the decomposition of hydrazine to chemically foam water-bearing explosives containing non-oxidizable thickeners. Iodates are disclosed among the representative oxidizing agents reported to be useful in the latter process. Neither of these foaming systems is employed in making the explosive product of this invention.

As has been discussed above, the iodate ion concentration that can be used with common thickeners such as guar gum in the product of this invention can be very low. When the explosive product of this invention contains both hydrazine and an iodate, or both hydrogen peroxide and an iodide, the concentrations of hydrazine, iodate, hydrogen peroxide, or iodide used are insufficient to produce a sensitizing amount of gas bubbles by reaction of iodate with hydrazine, or by the iodide-catalyzed decomposition of hydrogen peroxide, and therefore the present product is devoid of sensitizing gas bubbles formed by these reactions.

The thickener or gellant for the continuous aqueous phase is a polysaccharide, usually a gum or starch. Galactomannans constitute one of the industrially important classes of gums which can be employed, and locust bean gum and guar gum are the most important members of this class. Guar gum is preferred. Crosslinking agents preferably are used with galactomannan gums to hasten gel formation or to permit gel formation at relatively low gum concentrations. Such crosslinking agents are well-known, and include borax (U.S. Pat. No. 3,072,509), antimony and bismuth compounds (U.S. Pat. No. 3,202,556), and chromates (U.S. Pat. No. 3,445,305). Starch also may be used as the thickener, although at least about three times as much starch as guar gum usually is required. Combinations of thickeners also may be employed. Usually about from 0.1 to 5% galactomannan based on the total weight of the composition is employed.

As is conventional in water-bearing explosives, the explosives of this invention contain at least about 5%, and generally no more than about 30%, by weight of water. Preferably, the water content is in the range of about from 8 to 20% by weight based on the total composition.

In the following illustrative examples, parts and percentages are by weight.

EXAMPLE 1

Four different water gel explosives of the invention were prepared, two containing iodide ion, and the other two containing iodate ion.

Potassium iodide or iodate was dissolved in an aqueous solution (liquor) of about 73% by weight of monomethylamine nitrate (MMAN), which was at a temperature of 79°–82° C.; and this liquor was combined in a mixing vessel with an aqueous solution (liquor) of about 75% by weight of ammonium nitrate, also at 79°–82° C. The pH of the combined hot liquors was adjusted to approximately 4.0.

The following solids were mixed into the liquors: stearic acid, ammonium nitrate prills, gilsonite, perlite, and chopped foil aluminum of a size such that 100 weight % of the particles passed through a 30-mesh, and 92% were held on a 100-mesh, screen (Tyler sieve). A mixture of sodium nitrate and hydroxypropyl-substituted guar gum was added, and mixing was continued for 3–5 minutes until thickening was observed. Pigment-grade aluminum was added to the thickened mixture (sol), and mixing continued until the aluminum was well-blended. This aluminum was a dedusted grade of flake aluminum coated with stearic acid and having a typical surface area of 3–4 $m^2/g$. A water slurry of potassium pyroantimonate (a crosslinking agent) was added 6.5–7 minutes after the addition of the guar gum, mixing continued for one more minute, and the product discharged into polyethylene cartridges. The final pH was 5.0–5.3.

One hundred parts of the resulting gel contained the following:

| Ingredient | Parts |
|---|---|
| Ammonium nitrate | 51.6 (47.9 added as prills) |
| Sodium nitrate | 10.0 |
| MMAN | 23.7 |
| Water | 10.0 |
| Pigment-grade aluminum | 2.0 |
| Foil aluminum | 1.0 |
| Gilsonite | 1.7 |

The gels also contained 1 part guar gum, 0.04 part stearic acid, and 0.0074 part potassium pyroantimonate per 100 parts of the above "basic" formulation, and sufficient perlite to produce a density of 1.20–1.23 g/cc. Gel 1-A contained 0.040 part, and Gel 1-B 0.160 part, of potassium iodide (0.031 part and 0.122 part of iodide ion, respectively), on the same basis. Gel 1-C contained 0.052 part, and Gel 1-D 0.207 part, of potassium iodate (0.043 part and 0.169 part of iodate ion, respectively), on the same basis.

In addition to Gels 1-A through 1-D, a control gel was prepared as described above, but without the addition of potassium iodide or iodate.

All five gels were stored for 13 weeks at 49° C. All gels in 5-cm diameter detonated before and after storage at 3400–3600 m/sec when initiated at −12° C. by a No. 6 electric blasting cap.

Gel strength was evaluated manually by checking uniformly dimensioned sections of gel for body and firmness, and resistance to tearing and compression. All gels were strong and firm prior to storage.

After storage, Gels 1-A, 1-B, 1-C, and 1-D still had a significant degree of gel structure, whereas the control gel had almost no gel structure left and was essentially a thick mush. The iodide- and iodate-containing gels had more body, resilience, and firmness than the control gel. Gel strength ranked, in decreasing order, as follows:

1-A = 1-B > 1-C > 1-D > control

Although iodide ion and iodate ion both inhibited gel degradation, iodide ion conferred a greater degree of gel stability than iodate ion at the inhibitor levels used.

EXAMPLE 2

The procedure described in Example 1 was repeated except that the ammonium nitrate liquor, aluminum, gilsonite, and stearic acid were omitted. Adipic acid was added along with the ammonium nitrate prills and perlite.

The gels had the following basic composition per 100 parts of gel:

| | |
|---|---|
| Ammonium nitrate (added as prills) | 32.7 |
| Sodium nitrate | 14.8 |
| MMAN | 38.3 |
| Water | 14.2 |

In addition, the gels contained 1 part guar gum, 0.015 part adipic acid, and 0.0091 part potassium pyroantimonate per 100 parts of the above "basic" formulation, and sufficient perlite to produce a density of 1.02 to 1.05 g/cc. Gel 2-A contained 0.023 part, Gel 2-B 0.057 part, and Gel 2-C 0.113 part of potassium iodide (0.018, 0.044, and 0.086 part of iodide ion, respectively), on the same basis. Gel 2-D contained 0.073 part, and Gel 2-E 0.146 part, of potassium iodate (0.060 and 0.119 part of iodate ion, respectively), on the same basis.

Gels 2-A through 2-E and two control gels (which were the same as these except that they contained no iodide or iodate) were evaluated as described for the gels of Example 1. All of the fresh gels in 3.8 cm diameter detonated at about 3600–3700 m/sec when initiated at −7° C. by a No. 6 electric blasting cap.

After 5.5 weeks at 49° C., all of the KI- and $KIO_3$-containing gels were stronger than the two control gels. The gels ranked in strength as follows:

2-C > 2-B > 2-A > 2-E = 2-D > control 1 > control 2

After 10.5 weeks at 49° C., the gels ranked the same, although some softening was noted. Gel 2-E showed signs of iodine evolution, and concomitant loss of strength.

Although iodide ion and iodate ion both inhibited gel degradation, iodide ion again conferred a greater degree of gel stability than iodate ion at the inhibitor levels used.

EXAMPLE 3

The procedure described in Example 1 was repeated to prepare two different gels (3-A and 3-B) with the exception that potassium iodide was dissolved in the ammonium nitrate liquor, which was heated to 60° C., and the MMAN liquor and foil aluminum were omitted. Two control gels also were made. These were the same as Gels 3-A and 3-B except that they contained no potassium iodide.

One hundred parts of each gel contained the following:

| Ingredient | Parts |
|---|---|
| Ammonium nitrate | 65.7 (20.2 added as prills) |
| Sodium nitrate | 11.1 |
| Water | 15.2 |
| Pigment-grade aluminum | 4.0 |
| Gilsonite | 4.0 |

The gels also contained 0.50 part guar gum (nonderivatized), 0.08 part stearic acid, and 0.0038 part potassium pyroantimonate per 100 parts of the above "basic" formulation, and sufficient perlite to produce a density of 1.18–1.21 g/cc. Gel 3-A contained 0.057 part, and Gel 3-B 0.114 part, of potassium iodide (0.044 part and 0.087 part of iodide ion, respectively), on the same basis. All gels in 5-cm diameter detonated at about 3300 m/sec when initiated at 10° C. by a No. 8 electric blasting cap.

After one week at 49° C., Gels 3-A and 3-B were both firm, dry, and strong, whereas the two controls had become totally degraded to a mush, with liquid separation.

The following examples (4through 8) illustrate the effect of iodide and iodate ion in uncrosslinked thickened water-bearing explosives of the invention (sols). The stability of the sols was evaluated instrumentally by measurement of their viscosity with a Brookfield RVF viscometer operating at 20 rpm.

EXAMPLE 4

Potassium iodate was added to 400 grams of a saturated liquor consisting of 35.8% ammonium nitrate, 10.5% sodium nitrate, 39.2% MMAN, and 14.5% water in a 600-milliliter stainless steel container. The liquor was heated to 40°–60° C. with stirring to dissolve the iodate, then cooled to 26°–27° C., transferred to an 800-milliliter plastic container, and the pH adjusted to 5.0.

Four grams of hydroxypropyl-substituted guar gum was added slowly to the liquor, which was being stirred at about 1000 rpm with a three-blade propeller and shaft. Stirring at this rate was continued for 15 seconds after all of the guar gum had been added, and then the mixture was stirred at 500 rpm for 3.75 minutes. The mixture then was transferred to a 400-milliliter plastic container and placed in a 49° C. water bath for 12 minutes to allow hydration of the guar gum and formation of a thickened sol, after which time the sol was stirred rapidly for 30 seconds with a double-propeller shaft. Eight grams of the pigment-grade aluminum described in Example 1 then was added to the stirred sol, and stirring continued for 1.5 minutes at a speed sufficient to maintain a vortex in the thickened sol.

Five different sols were made, each with a different potassium iodate concentration. Two control sols also were made, both of which contained no iodate, and one of which (Control Sol 2) contained no aluminum. The sols were covered with plastic film and placed in a 49° C. water bath for 2 weeks. Sol degradation was determined by the drop in viscosity measured after 312 hours. The results were as follows:

| Sol No. | $KIO_3$ (g) | $IO_3^-$ (%) | Viscosity (cp) of Sol at Age 1 hr | 312 hrs |
|---|---|---|---|---|
| 4-A | 0.062 | 0.012 | 12890 | 5015 |
| 4-B | 0.123 | 0.024 | 13465 | 5615 |
| 4-C | 0.308 | 0.061 | 13545 | 5455 |
| 4-D | 0.62 | 0.123 | 13110 | 6145 |
| 4-E | 1.23 | 0.244 | 13000 | 7265 |
| Control Sol 1 | — | — | 14195 | 4415 |
| Control Sol 2* | — | — | 13400 | 6315 |

*Al—free

The results show that, while all of the fresh sols had viscosities of about 13,000–14,000 cp, after 312 hours Control Mix 1, which contained aluminum but no iodate ion, had a viscosity of only 4415 cp, in contrast to the iodate-containing aluminized sols, which had viscosities of 5015–7265 cp, indicative of the stabilizing effect of the iodate ion on the aluminized composition, increasing viscosity (and stability) having resulted with increasing iodate concentration in the range of 0.012% to 0.244%.

The results also show that a nonaluminized guar-thickened sol (Control Sol 2) also degrades when stored at 49° C. for 312 hours, but not to the extent that an aluminized sol does. Iodate ion in concentrations of 0.123% and 0.244% (Sols 4-D and 4-E) improved the stability of the aluminized sol to the degree that it equalled or exceeded that of the nonaluminized sol.

EXAMPLE 5

The preparation and test procedure described in Example 4 was repeated except that potassium iodide was substituted for the potassium iodate. Also, a more reactive form of pigment-grade aluminum was used. Two different series of sols were made. In one, Series II, the stirring for 15 seconds after the guar gum had been added was carried out at 800 rpm instead of 1000 rpm, and the hydration time was 11 minutes instead of 12. The aluminum used in the two series was taken from different manufacturer's lots. The results were as follows:

Series I

| Sol No. | KI (g) | $I^-$ (%) | Viscosity (cp) of Sol at Age 1 hr | 335 hrs |
|---|---|---|---|---|
| 5-A | 0.024 | 0.004 | 12965 | 2558 |
| 5-B | 0.048 | 0.009 | 13610 | 5865 |
| 5-C | 0.096 | 0.018 | 13270 | 5030 |
| 5-D | 0.239 | 0.044 | 13640 | 8260 |
| 5-E | 0.48 | 0.089 | 13925 | 9810 |
| 5-F | 0.96 | 0.178 | 12795 | 9815 |
| Control Sol 1 | — | | 12895 | 414 |
| Control Sol 2* | — | | 12640 | 6555 |

Al—free

Series II

| Sol No. | KI (g) | $I^-$ | Viscosity (cp) of Sol at Age 1 hr | 308 hrs |
|---|---|---|---|---|
| 5-G | 0.0005 | 1 ppm | 12930 | 4288 |
| 5-H | 0.0024 | 4 ppm | 13215 | 5780 |
| 5-I | 0.0048 | 9 ppm | 12945 | 5480 |
| 5-J | 0.0096 | 18 ppm | 13360 | 6115 |
| 5-K | 1.0 | 0.18% | 13635 | 12525* |
| 5-L | 2.0 | 0.37% | 13205 | 12015* |
| 5-M | 4.0 | 0.74% | 12700 | 11950* |
| 5-N | 8.0 | 1.48% | 11330 | 10950* |
| Control Sol | — | — | 13085 | 4265 |

*Measured at sol age 306 hrs

With respect to Series I, all of the fresh sols, as in Example 4, had viscosities of about 13,000–14,000 cp. In this case, however, Control Sol 1, which contained aluminum but no iodide ion, had a 335-hour viscosity of only 414 cp (in contrast to Control Sol 1 of Example 4), indicative of almost complete degradation, presumably caused by the more reactive aluminum used. The stabilizing effect of the iodide ion at concentration levels of 0.004–0.178% on the Series I aluminized sol can be seen by contrasting Sols 5-A through 5-F, which had viscosities after 335 hours of 2558 to 9815 cp (increasing with increasing iodide concentration), with Control Sol 1 (414 cp). Moreover, iodide ion in concentrations of 0.044%, 0.089%, and 0.178% (Sols 5-D, 5-E, and 5-F) improved the stability of this aluminized sol to the degree that it exceeded that of the non-aluminized sol (Control Sol 2).

In Series II, the control sol was the same as Sols 5-G through 5-N except that it contained no iodide (i.e., it was an aluminized sol). Possibly owing to a difference in the purities of the aluminums from the two different lots, the Series II control sol degraded less during 49° C. storage than Control Sol 1 of Series I, but nevertheless showed a considerable degree of degradation. The results of the Series II tests show that iodide ion in concentrations as low as 4 parts per million exerts a degradation-inhibiting effect in aluminized sols, and that iodide ion concentrations of about from 0.2% to 1.5% result in little if any degradation over a 306-hour period at 49° C.

EXAMPLE 6

Two sols (6-A and 6-B) were prepared by the procedure described in Example 4 with the exception that no aluminum was added to either sol, and potassium iodide was substituted for potassium iodate in Sol 6-B. After the 12-minute hydration period, the sols were stirred for 2-minutes prior to storage at 49° C. The results were as follows:

| Sol No. | Inhibitor (g) | | Viscosity (cp) of Sol at Age 1 hr | 356 hrs |
|---|---|---|---|---|
| 6-A | $KIO_3$ | (3.08) (0.623% $IO_3^-$) | 12675 | 8790 |
| 6-B | KI | (0.48) (0.091% $I^-$) | 12150 | 9125 |
| Control Sol | — | | 12985 | 6700 |

The control sol was the same as Sols 6-A and 6-B except that it contained neither iodate nor iodide ion. The results show that guar-containing sols containing no aluminum also are stabilized against degradation by the iodide and iodate ion. The results also show that iodide ion is effective as a degradation inhibitor at a lower concentration level than iodate ion.

EXAMPLE 7

The procedure described in Example 4 was repeated except that calcium iodide was substituted for the potassium iodate. Three sols (7-A, 7-B, and 7-C) were prepared containing different calcium iodide concentrations. A control sol, which was the same as Sols 7-A through 7-C except that it contained no iodide, also was prepared. The results were as follows:

| Sol No. | $CaI_2$ (g) | $I^-$ (%) | Viscosity (cp) of Sol at Age 1 hr | 218 hrs |
|---|---|---|---|---|
| 7-A | 0.21 | 0.044 | 13365 | 12755 |
| 7-B | 0.53 | 0.111 | 12470 | 12040 |
| 7-C | 1.05 | 0.220 | 11575 | 11570 |
| Control Sol | — | — | 12915 | 8210 |

The sols which contained calcium iodide showed little evidence of degradation (decrease in viscosity) after 218 hours at 49° C., whereas these conditions produced a substantial decrease in viscosity, indicative of a substantial degree of degradation, in the sol which contained no iodide.

EXAMPLE 8

The procedure of Example 4 was repeated with the exception that the 4 grams of guar gum was replaced by 16 grams of a room-temperature-dispersible starch. Hydration time in the 49° C. water bath was 11 minutes. The results were as follows:

| Sol No. | Inhibitor (g) | | Viscosity (cp) of Sol at Age 1 hr | 384 hrs |
|---|---|---|---|---|
| 8-A | KI | (0.239) (0.043% $I^-$) | 12385 | 5880 |
| 8-B | $KIO_3$ | (1.23) (0.237% $IO_3^-$) | 11510 | 5290 |
| Control Sol 1 | — | | 12105 | 4420 |
| Control Sol 2* | — | | 12620 | 6085 |

*Al—free

The aluminized starch-thickened sols containing iodide or iodate ion were less degraded after 384 hours at 49° C. (as evidenced by the decrease in their viscosity) than the aluminized control sol. At the level of inhibitor concentration used, the iodide-containing sol exhibited about the same stability as an iodide-free sol containing no aluminum.

EXAMPLE 9

The procedure described in Example 4 was modified in the following manner:

After the pigment-grade aluminum had been added, stirring was continued for 30 seconds, and then one milliliter of a 1.07% aqueous potassium pyroantimonate solution was injected into the sol dropwise. Stirring was continued for an additional minute. The mix was covered with plastic film and set aside overnight at room temperature to allow crosslinking. Then it was placed in the 49° C. water bath and monitored for degradation or weakening by estimating the relative gel strength by measurements made with a cone penetrometer produced by the Precision Scientific Company. The instrument was fitted with a 60° Delrin ® cone and an aluminum spindle (26.1 gram moving mass). The depth of penetration of the cone into the gel was measured 10 seconds after the cone was released. A lower penetrometer reading (less cone penetration) indicated a stronger gel.

Six different gels were made, three of which contained iodide ion, and the three others iodate ion. Two control gels also were made, both of which contained neither iodide nor iodate, and one of which (Control Gel 2) contained no aluminum. The results of the penetrometer tests were as follows:

| Gel No. | Inhibitor (g) | | Penetrometer Readings (× 0.1 = mm) on Gel at Age ~45 hrs | ~240 hrs |
|---|---|---|---|---|
| 9-A | $KIO_3$ | (0.062) (0.012% $IO_3^-$) | 235.8 | 305.0 |
| 9-B | $KIO_3$ | (0.308) (0.061% $IO_3^-$) | 234.8 | 296 |
| 9-C | $KIO_3$ | (1.23) (0.244% $IO_3^-$) | 231.2 | 289 |
| 9-D | KI | (0.048) (0.009% $I^-$) | 224.8,235.6** | 284.7,283** |
| 9-E | KI | (0.239) (0.044% $I^-$) | 231.4 | 278 |
| 9-F | KI | (0.96) (0.178% $I^-$) | 235.0 | 277 |
| Control Gel 1 | | | 232.8 | 315.2 |
| Control Gel 2* | | | 236.0 | 288.6 |

*Al—free
**Duplicate gels

The penetrometer results show that although the strength of the inhibitor-free aluminized gel (Control Gel 1) at an early period was about the same as that of gels containing iodide or iodate ion, this control gel was weaker than the inhibited gels after 240 hours. As was found in the case of sols (Examples 4 and 5), stability increased (penetrometer reading decreased) as inhibitor concentration increased. The stability of the iodide-containing aluminized gels was equal to, or greater than, that of the nonaluminized control.

EXAMPLE 10

The procedure described in Example 9 was repeated with the following exceptions:

The nitrate liquor was prepared by adding ammonium nitrate prills to a hot waste liquor which consisted essentially of 29.7% ammonium nitrate, 8.7% sodium nitrate, 17.1% MMAN, and 44.5% water, and contained trace amounts of other metal ions, chiefly aluminum ion at a concentration of 2955 parts per million, as determined by Plasma Emission Spectroscopy. The prills were added in the amount of 78 grams per 100 grams of hot waste liquor. This increased the total nitrate salt concentration of the waste liquor to 75%. Ten parts of this 75% nitrate liquor then was added to 90 parts of the saturated nitrate liquor described in Example 4. The composition of the combined liquors was as follows:

| | |
|---|---|
| Ammonium nitrate | 38.3% |
| Sodium nitrate | 9.9% |
| MMAN | 36.2% |
| Water | 15.6% |
| Aluminum (as ions or in precipitated form) | ~166 ppm |

This liquor was converted into a gel by converting it first into a sol as described in Example 4, except that potassium iodide was substituted for the potassium iodate. The sol, which contained pigment-grade aluminum, was converted into a gel, stored, and tested as described in Example 9. In this instance, however, the moving mass of the penetrometer cone and spindle was 36.5 grams.

Two gels were made containing iodide ion. Two control gels also were made, both of which contained no iodide ion. Control Gel 1 was made with the waste liquor as described above; Control Gel 2 was made in the same manner except that the liquor was totally virgin liquor prepared as described in Example 4. The results of the penetrometer tests were as follows:

| Gel No. | KI (g) | $I^-$ (%) | Penetrometer Readings (× 0.1 = mm) on Gel at Age 26 hrs | 240 hrs |
|---|---|---|---|---|
| 10-A | 0.24 | 0.045 | 267.6* 265.8* | 345.8* 349.2* |
| 10-B | 0.96 | 0.178 | 271.0 | 339.0 |
| Control Gel 1 | — | — | 268.6 | 372.4 |
| Control Gel 2** | — | — | 262.8 | 353.0 |

*Duplicate mixes
**Virgin liquor only

The penetrometer readings for the iodide-containing gels and Control Gel 1, which, like Gels 10-A and 10-B, was made with waste liquor and contained ~166 ppm of aluminum (ion or precipitated), show that although gel strength was about the same at an early period, the iodide-containing gels remained more stable (gave lower readings) over a 240-hour period. Comparison of the results obtained with the two control gels shows that aluminum ion or precipitated aluminum compounds in the nitrate liquor exert a detrimental effect on gel stability. This effect can be offset by means of the present invention, however. A comparison of the results obtained with Gels 10-A/10-B and Control Gel 2 shows that an iodide-containing gel made with waste liquor is more stable after 240 hours than an uninhibited gel made with totally virgin liquor.

The iodide or iodate which is added to the aqueous liquor or sol to form the product of this invention is dissolved therein and therefore is in the ionized form during preparation. However, the product may subsequently be subjected to conditions which cause some of the iodide or iodate to crystallize out of solution, but it is believed that at least a portion of iodide or iodate is present in the product in ionized form. Therefore, the terms "iodide ion" and "iodate ion", as used herein to denote the stabilizer, refer to iodide and iodate in dissolved as well as crystallized form.

I claim:

1. A method of stabilizing the thickened or gelled structure of a water-bearing explosive comprising oxidizer, fuel, and sensitizer components in a thickened or gelled continuous aqueous phase, said method comprising incorporating in the explosive a thermally stabilizing amount of iodide ion, iodate ion, or a combination of iodide and iodate ions.

2. A method of claim 1 wherein an iodide salt, an iodate salt, hydriodic acid, iodic acid, or any combination of said salts and acids is dissolved in an aqueous liquor or sol containing said oxidizer component.

3. A method of claim 2 wherein said iodide salt is selected from the group consisting of ammonium iodide, alkyl-substituted ammonium iodides, and alkali metal and alkaline-earth metal iodides, and said iodate salt is selected from the group consisting of ammonium iodate, alkyl-substituted ammonium iodates, and alkali metal and alkaline-earth metal iodates.

4. A method of claim 3 wherein said iodide salt is potassium or sodium iodide, and said iodate salt is potassium or sodium iodate.

5. A method of claim 1 wherein said thickened or gelled structure is stabilized by incorporating a thermally stabilizing amount of iodide ion in the explosive.

6. A method of claim 1 wherein said thickened or gelled structure is stabilized by incorporating a thermally stabilizing amount of iodate ion in the explosive.

7. A method of claim 5 wherein the amount of iodide ion is at least 4 parts per million parts of explosive by weight.

8. A method of claim 6 wherein the amount of iodate ion is from 0.010 to 0.3 percent of the weight of the explosive.

9. In a water-bearing explosive comprising oxidizer, fuel, and sensitizer components in a continuous aqueous phase having a thickened or gelled structure, the improvement comprising a stabilizer of the thickened or gelled structure comprising iodide ion, iodate ion, or a combination of iodide and iodate ions, said sensitizer component being devoid of a sensitizing amount of gas bubbles formed (a) by the decomposition of hydrogen peroxide, when the stabilizer contains iodide ion and (b) by the decomposition of a nitrogen compound, when the stabilizer contains iodate ion.

10. An explosive of claim 9 wherein said stabilizer is iodide ion in the amount of at least 4 parts per million parts of explosive by weight.

11. An explosive of claim 9 wherein said stabilizer is iodate ion in the amount of 0.010 to 0.3 percent of the explosive by weight.

12. An explosive of claim 9 containing finely divided aluminum, as a fuel and/or as part of the sensitizer component.

13. An explosive of claim 12 containing flake aluminum.

14. An explosive of claim 9 wherein the aqueous phase is thickened with a galactomannan gum or starch.

15. An explosive of claim 14 wherein the aqueous phase is gelled with a crosslinked galactomannan gum.

16. In a water-bearing explosive comprising oxidizer, fuel, and sensitizer components in a continuous aqueous phase thickened or gelled with a galactomannan gum or starch, said explosive including aluminum in ionic form or solid elemental or combined form, the improvement comprising a stabilizer of the thickened or gelled structure comprising iodide ion in the amount of at least 0.003 percent, and/or iodate ion in the amount of 0.020 to 0.3 percent, of the explosive by weight, said sensitizer component being devoid of a sensitizing amount of gas bubbles formed (a) by the decomposition of hydrogen peroxide, when the stabilizer contains iodide ion and (b) by the decomposition of a nitrogen compound, when the stabilizer contains iodate ion.

17. An explosive of claim 16 containing, as part of the sensitizer component, at least one salt of an alkylamine or alkanolamine with nitric or perchloric acid.

18. An explosive of claim 16 gelled with about from 0.1 to 5 percent by weight of cross-linked guar gum.

19. An explosive of claim 16, 17, or 18 containing flake aluminum as part of the sensitizer component.

20. A method of claim 1, 3, or 5 wherein substantially all gas bubbles forming at least a part of said sensitizer component are incorporated into the explosive by the direct injection of gas, by mechanical agitation, and/or by the addition of air-carrying solid material.

21. A method of claim 5 wherein said iodide ion is incorporated in the explosive by dissolving, in an aqueous liquor or sol containing said oxidizer component, at least one iodide salt selected from the group consisting of ammonium iodide, alkyl-substituted ammonium iodides, and alkali metal and alkaline-earth metal iodides.

22. A method of claim 6 wherein said iodate ion is incorporated in the explosive by dissolving, in an aqueous liquor or sol containing said oxidizer component, at least one iodate salt selected from the group consisting of ammonium iodate, alkyl-substituted ammonium iodates, and alkali metal and alkaline-earth metal iodates.

23. An explosive of claim 9 or 16 wherein said stabilizer is iodide ion derived from at least one member of the group consisting of alkali metal and alkaline-earth metal iodides, ammonium iodide, alkylammonium iodides, and hydriodic acid.

24. A method of claim 5 wherein said explosive has an aqueous phase which has been gelled by the crosslinking of a thickener therein resulting from the action of a crosslinking agent distinct from said iodide.

25. A method of claim 1 wherein said sensitizer component is devoid of a sensitizing amount of gas bubbles formed (a) by the decomposition of hydrogen peroxide when a thermally stabilizing amount of iodide ion is incorporated in said explosive and (b) by the decomposition of a nitrogen compound when a thermally stabilizing amount of iodate is incorporated in said explosive; with the proviso that when said aqueous phase is gelled and contains the cerous ion, said explosive is iodide-free and stabilized by incorporating iodate ion therein.

26. An explosive of claim 9 or claim 16 wherein any gelled structure therein which contains cerous ion is iodide-free and stabilized with iodate ion.

* * * * *